US008294649B2

(12) United States Patent
Yang et al.

(10) Patent No.: US 8,294,649 B2
(45) Date of Patent: Oct. 23, 2012

(54) DRIVING DEVICE FOR DISPLAY DEVICE AND IMAGE SIGNAL COMPENSATING METHOD THEREFOR

(75) Inventors: Young-Chol Yang, Seongnam-si (KR); Baek-Woon Lee, Yongin-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 1041 days.

(21) Appl. No.: 11/778,195

(22) Filed: Jul. 16, 2007

(65) Prior Publication Data

US 2008/0079675 A1 Apr. 3, 2008

(30) Foreign Application Priority Data

Aug. 2, 2006 (KR) ..... 10-2006-0072976

(51) Int. Cl.
*G09G 3/36* (2006.01)

(52) U.S. Cl. ..... 345/89; 345/98; 345/204

(58) Field of Classification Search ..... 345/98, 345/89, 204

See application file for complete search history.

(56) References Cited

U.S. PATENT DOCUMENTS

| | | | | |
|---|---|---|---|---|
| 6,850,215 | B2 | 2/2005 | Lee et al. | |
| 6,972,745 | B2 * | 12/2005 | Pfeiffer et al. | 345/89 |
| 6,980,225 | B2 | 12/2005 | Funamoto et al. | |
| 7,002,540 | B2 | 2/2006 | Aoki | |
| 2003/0006952 | A1 | 1/2003 | Hong | |
| 2003/0011614 | A1 | 1/2003 | Itoh et al. | |
| 2003/0025656 | A1 | 2/2003 | Kimura | |
| 2003/0184569 | A1 | 10/2003 | Koga et al. | |
| 2003/0222840 | A1 | 12/2003 | Koga et al. | |
| 2004/0196274 | A1 * | 10/2004 | Song et al. | 345/204 |
| 2006/0066554 | A1 * | 3/2006 | Baba et al. | 345/98 |
| 2006/0125812 | A1 * | 6/2006 | Lee | 345/204 |

FOREIGN PATENT DOCUMENTS

| | | |
|---|---|---|
| EP | 1662474 A1 | 5/2006 |
| JP | 2003-255908 | 9/2003 |
| JP | 2005-164937 | 6/2005 |
| JP | 2004-178846 | 1/2006 |

(Continued)

OTHER PUBLICATIONS

European Search Report dated Aug. 31, 2009 for Application No. 07014960.4-2205.

(Continued)

*Primary Examiner* — Amare Mengistu
*Assistant Examiner* — Joseph G Rodriguez
(74) *Attorney, Agent, or Firm* — F. Chau & Associates, LLC

(57) ABSTRACT

A driving device for a display device and a method of compensating an image signal of the display device in which the driving device for a display device having a plurality of pixels includes: a first compensating unit that converts an image signal corresponding to the pixel into a first compensated signal according to a difference between the image signal, and an image signal in a previous frame; a second compensating unit that converts the first compensated signal corresponding to the pixel into first and output image signals; an edge detecting unit that outputs a signal according to whether the pixel exists in an edge region in an image based on a difference between image signals corresponding to peripheral pixels; and a first calculating unit that generates converted signals of the first and second output signals based on the output signal of the edge detecting unit.

15 Claims, 20 Drawing Sheets

FOREIGN PATENT DOCUMENTS

| | | | |
|---|---|---|---|
| JP | 2006-098803 | | 4/2006 |
| JP | 08-069264 | | 7/2007 |
| KR | 2001-0053114 | | 6/2001 |
| KR | 1020030058762 | A | 7/2003 |
| KR | 100459993 | | 11/2004 |
| KR | 100557502 | | 2/2006 |

OTHER PUBLICATIONS

English Abstract for Publicatio No. 2003-255908.
English Abstract for Publicatio No. 2006-098803.

* cited by examiner

FIG.4

| | | $I_{N-1}$ | | | | | | | | |
|---|---|---|---|---|---|---|---|---|---|---|
| | | 0 | 32 | 64 | 96 | 128 | 160 | 192 | 224 | 255 |
| $I_N$ | 0 | 0 | 0 | 0 | 0 | 0 | 0 | 0 | 0 | 0 |
| | 32 | 115 | 32 | 22 | 20 | 15 | 15 | 15 | 15 | 15 |
| | 64 | 169 | 103 | 64 | 50 | 34 | 27 | 22 | 20 | 16 |
| | 96 | 192 | 146 | 118 | 96 | 87 | 70 | 54 | 36 | 29 |
| | 128 | 213 | 167 | 156 | 143 | 128 | 121 | 105 | 91 | 70 |
| | 160 | 230 | 197 | 184 | 179 | 174 | 160 | 157 | 147 | 129 |
| | 192 | 238 | 221 | 214 | 211 | 205 | 199 | 192 | 187 | 182 |
| | 224 | 250 | 245 | 241 | 240 | 238 | 238 | 224 | 224 | 222 |
| | 255 | 255 | 255 | 255 | 255 | 255 | 255 | 255 | 255 | 255 |

FIG.8

| First preliminarily - compensated signal | Lower signal(Ln) | Upper signal(Hn) |
|---|---|---|
| 0 | 0 | 0 |
| 16 | 0 | 80 |
| 32 | 0 | 100 |
| 48 | 0 | 115 |
| 64 | 0 | 129 |
| 80 | 0 | 143 |
| 96 | 0 | 156 |
| 112 | 0 | 185 |
| 128 | 4 | 203 |
| 144 | 8 | 220 |
| 160 | 15 | 233 |
| 176 | 22 | 242 |
| 192 | 26 | 252 |
| 208 | 89 | 255 |
| 224 | 154 | 255 |
| 240 | 224 | 255 |
| 255 | 255 | 255 |

FIG.11A

| | | | | | | |
|---|---|---|---|---|---|---|
| −1 | −2 | −3 | 0 | +3 | +2 | +1 |
| −1 | −2 | −3 | 0 | +3 | +2 | +1 |
| −1 | −2 | −3 | 0 | +3 | +2 | +1 |
| −1 | −2 | −3 | 0 | +3 | +2 | +1 |
| −1 | −2 | −3 | 0 | +3 | +2 | +1 |

FIG.11B

| | | | | | | |
|---|---|---|---|---|---|---|
| −1 | −1 | −1 | −1 | −1 | −1 | −1 |
| −2 | −2 | −2 | −2 | −2 | −2 | −2 |
| 0 | 0 | 0 | 0 | 0 | 0 | 0 |
| +2 | +2 | +2 | +2 | +2 | +2 | +2 |
| +1 | +1 | +1 | +1 | +1 | +1 | +1 |

FIG.17A

| Lower gray | | Final gray | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| Inti. gray | 0 | 0 | 37 | 68 | 87 | 96 | 96 | 96 | 102 | 118 | 146 | 180 | 214 | 240 | 252 | 255 | 255 | 255 |
| | 16 | 0 | 0 | 27 | 34 | 41 | 55 | 72 | 91 | 114 | 143 | 177 | 211 | 237 | 251 | 255 | 256 | 255 |
| | 32 | 0 | 0 | 0 | 1 | 4 | 22 | 48 | 78 | 110 | 142 | 174 | 205 | 230 | 247 | 255 | 257 | 255 |
| | 48 | 0 | 0 | 0 | 0 | 1 | 3 | 24 | 62 | 106 | 143 | 171 | 195 | 217 | 239 | 254 | 258 | 255 |
| | 64 | 0 | 0 | 0 | 0 | 0 | 1 | 6 | 45 | 96 | 137 | 166 | 187 | 208 | 233 | 252 | 258 | 255 |
| | 80 | 0 | 0 | 0 | 0 | 0 | 0 | 2 | 29 | 73 | 118 | 157 | 185 | 208 | 231 | 249 | 255 | 255 |
| | 96 | 0 | 0 | 0 | 0 | 0 | 0 | 0 | 14 | 45 | 93 | 140 | 172 | 196 | 222 | 244 | 253 | 255 |
| | 112 | 0 | 0 | 0 | 0 | 0 | 0 | 0 | 0 | 20 | 67 | 114 | 136 | 155 | 195 | 235 | 253 | 255 |
| | 128 | 0 | 0 | 0 | 0 | 0 | 0 | 0 | 0 | 4 | 42 | 80 | 93 | 112 | 167 | 226 | 251 | 255 |
| | 144 | 0 | 0 | 0 | 0 | 0 | 0 | 0 | 0 | 4 | 8 | 43 | 60 | 93 | 156 | 219 | 248 | 255 |
| | 160 | 0 | 0 | 0 | 0 | 0 | 0 | 0 | 0 | 3 | 6 | 15 | 36 | 80 | 148 | 212 | 244 | 255 |
| | 176 | 0 | 0 | 0 | 0 | 0 | 0 | 0 | 0 | 2 | 3 | 7 | 22 | 55 | 130 | 204 | 242 | 255 |
| | 192 | 0 | 0 | 0 | 0 | 0 | 0 | 0 | 0 | 1 | 5 | 7 | 4 | 26 | 107 | 192 | 237 | 255 |
| | 208 | 0 | 0 | 0 | 0 | 0 | 0 | 0 | 0 | 0 | 1 | 5 | 10 | 18 | 89 | 173 | 226 | 255 |
| | 224 | 0 | 0 | 0 | 0 | 0 | 0 | 0 | 0 | 0 | 0 | 1 | 3 | 15 | 77 | 154 | 213 | 255 |
| | 240 | 0 | 0 | 0 | 0 | 0 | 0 | 0 | 0 | 0 | 0 | 1 | 2 | 10 | 66 | 139 | 224 | 255 |
| | 255 | 0 | 0 | 0 | 0 | 0 | 0 | 0 | 0 | 0 | 0 | 1 | 2 | 3 | 55 | 128 | 196 | 255 |

FIG.17B

| Higher gray | | Final gray | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| Inti. gray | 0 | 0 | 100 | 124 | 143 | 150 | 168 | 192 | 213 | 230 | 242 | 250 | 254 | 255 | 255 | 255 | 255 | 255 |
| | 16 | 0 | 80 | 110 | 131 | 139 | 152 | 173 | 200 | 225 | 238 | 244 | 250 | 255 | 255 | 255 | 255 | 255 |
| | 32 | 0 | 57 | 100 | 122 | 131 | 141 | 160 | 191 | 220 | 234 | 240 | 248 | 255 | 255 | 255 | 255 | 255 |
| | 48 | 0 | 54 | 96 | 115 | 129 | 139 | 157 | 188 | 217 | 231 | 238 | 248 | 255 | 255 | 255 | 255 | 255 |
| | 64 | 0 | 54 | 96 | 118 | 129 | 140 | 158 | 187 | 214 | 229 | 238 | 248 | 255 | 255 | 255 | 255 | 255 |
| | 80 | 0 | 54 | 96 | 118 | 129 | 143 | 157 | 186 | 210 | 227 | 237 | 247 | 253 | 255 | 255 | 255 | 255 |
| | 96 | 0 | 54 | 96 | 118 | 128 | 139 | 156 | 185 | 207 | 224 | 236 | 245 | 252 | 255 | 255 | 255 | 255 |
| | 112 | 0 | 53 | 94 | 117 | 128 | 139 | 156 | 185 | 205 | 223 | 235 | 245 | 252 | 255 | 255 | 255 | 255 |
| | 128 | 0 | 52 | 93 | 116 | 128 | 138 | 153 | 180 | 203 | 221 | 234 | 245 | 253 | 255 | 255 | 255 | 255 |
| | 144 | 0 | 51 | 93 | 116 | 127 | 133 | 146 | 178 | 200 | 220 | 233 | 245 | 252 | 255 | 255 | 255 | 255 |
| | 160 | 0 | 51 | 92 | 116 | 127 | 132 | 143 | 174 | 198 | 219 | 233 | 244 | 252 | 255 | 255 | 255 | 255 |
| | 176 | 0 | 49 | 89 | 113 | 127 | 131 | 140 | 173 | 199 | 218 | 233 | 242 | 253 | 255 | 255 | 255 | 255 |
| | 192 | 0 | 43 | 80 | 105 | 120 | 128 | 135 | 165 | 198 | 218 | 232 | 244 | 252 | 255 | 255 | 255 | 255 |
| | 208 | 0 | 34 | 64 | 88 | 101 | 103 | 114 | 150 | 191 | 216 | 230 | 239 | 247 | 255 | 255 | 255 | 255 |
| | 224 | 0 | 24 | 48 | 70 | 75 | 80 | 90 | 123 | 176 | 209 | 224 | 233 | 240 | 248 | 255 | 255 | 255 |
| | 240 | 0 | 18 | 38 | 60 | 69 | 75 | 85 | 107 | 153 | 190 | 213 | 225 | 234 | 246 | 255 | 255 | 255 |
| | 255 | 0 | 15 | 32 | 50 | 64 | 71 | 80 | 98 | 128 | 166 | 200 | 219 | 230 | 244 | 254 | 255 | 255 |

DRIVING DEVICE FOR DISPLAY DEVICE AND IMAGE SIGNAL COMPENSATING METHOD THEREFOR

CROSS-REFERENCE TO RELATED APPLICATION

This application claims priority to and the benefit of Korean Patent Application No. 10-2006-0072976 filed in the Korean intellectual Property Office on Aug. 2, 2006, the entire contents of which are incorporated herein by reference.

BACKGROUND OF THE INVENTION (a) Technical Field

The present disclosure relates to a driving device for a display device and an image signal compensating method therefor.

(b) Discussion of Related Art

As one of the current widely-used flat panel display devices, a liquid crystal display device includes two display panels on which field generating electrodes, such as a pixel electrode, and a common electrode, are disposed and a liquid crystal layer interposed therebetween. When voltages are applied to the field generating electrodes, an electric field is generated in the liquid crystal layer to determine alignment of the liquid crystal molecules of the liquid crystal layer and to control polarization of incident light, so that an image can be displayed.

The liquid crystal display includes switching elements connected to the pixel electrodes and a plurality of signal lines such as gate and data lines for controlling the switching elements to apply voltages to the pixel electrodes.

Such a liquid crystal display has been widely used as a display screen for a television set or the like, as well as a display device for a computer. Therefore, there is a need to display motion pictures on the liquid crystal, display. Since a response speed of the liquid crystal molecules of the liquid crystal display is slow, however, it is difficult to display the motion picture properly.

More specifically, since the response speed of the liquid crystal molecule is slow, a finite amount of time is spent until a voltage charged in a liquid crystal capacitor approaches a target voltage, that is, a voltage by which the desired luminance can be obtained. The time varies with a difference between the target voltage and a voltage previously charged in the liquid crystal capacitor. For example, when the target voltage is quite different from the previously charged voltage, the target voltage may not be obtained by applying only the previous voltage during a time that the switching element is turned on.

On the other hand, in such a liquid crystal display, particularly, a liquid crystal display using a vertical electric field, optical phase retardation of the liquid crystal molecules varies with a viewing angle, so that a front transmittance characteristic is different from a side transmittance characteristic. As a result, front visibility is different from side visibility.

As a result of an experiment for measuring transmittance of a liquid crystal display according to gray values, in a low gray value, the transmittance increases in a side portion. On the contrary, in a high gray value, the transmittance decreases in the side portion. In this manner, due to difference in transmittance according to the viewing angle, the difference in transmittance between the gray values decreases in the side portion, so that side visibility deteriorates.

As a method of preventing deterioration in the side visibility, there has been proposed a method of dividing one pixel into two subpixels and applying a normal voltage to the one subpixel and a higher or lower voltage to the other subpixel, so as to charge the liquid crystal capacitor with different voltages, so that the visibility can be improved.

In the method of dividing one subpixel into two subpixels, however, since it is difficult to apply accurate voltages suitable for the gray values, there is a limitation on improving the visibility.

The above information disclosed in this Background section is only for enhancement of understanding of the background of the invention and, therefore, it may contain information that does not form the prior art that is already known in this country to a person of ordinary skill in the art.

SUMMARY OF THE INVENTION

Exemplary embodiments of the present invention have been made in an effort to provide a driving device for a display device having the advantages of reducing a difference between front and lateral visibilities, so as to improve image quality of a liquid crystal display.

In addition, exemplary embodiments of the present invention have been made in an effort to provide a driving device for a display device having the advantages of increasing a response speed of liquid crystal molecules and preventing occurrence of blurring and flicker.

An exemplary embodiment of the present invention provides a driving device for a display device having a plurality of pixels, comprising: a compensating unit that converts image signals corresponding to the pixels into first and second output image signals; an edge detecting unit that outputs a signal according to whether the pixel exists in an edge region in an image based on a difference between image signals corresponding to peripheral pixels; a first calculating unit that generates converted signals of the first and second output signals based on the output signal of the edge detecting unit.

An exemplary embodiment of the present invention provides a driving device for a display device having a plurality of pixels, comprising: a first compensating unit that converts an image signal corresponding to the pixel into a first compensated signal according to a difference between the image signal and an image signal in a previous frame; a second compensating unit that converts the first compensated signal corresponding to the pixel into first output image signals; an edge detecting unit that outputs a signal according to whether the pixel exists in an edge region in an image based on a difference between image signals corresponding to peripheral pixels; and a first calculating unit that generates converted signals of the first and second output signals based on the output signal of the edge detecting unit.

An exemplary embodiment of the present invention provides a driving device for a display device having a plurality of pixels, comprising: a first compensating unit that converts an image signal corresponding to the pixel into a first compensated signal according to a difference between the image signal and an image signal in a previous frame; a second compensating unit that converts the image signal into first and second output image signals based on the image signal corresponding to the pixel and the image signal in the previous frame; an edge detecting unit that outputs a signal according to whether or not the pixel exists in an edge region in an image based on a difference between image signals corresponding to peripheral pixels; and a first calculating unit that generates converted signals of the first and second output signals based on the output signal of the edge detecting unit.

In the exemplary embodiments of the present invention, when the pixel does not exist in the edge region of the image, the converted signals of the first and second output image signals may be equal to the image signal.

The edge detecting unit may comprise: a second calculating unit that calculates a difference in gray values between the pixels; and a scale adjusting unit that calculates the edge variable based on information on the difference in gray values received from the second calculating unit.

The driving device may further comprise a multiplexer that selects one of converted signals of the first and second output image signals and outputs the selected signal.

The first output image signal may be greater than the second output image signal An exemplary embodiment of the present invention provides a driving device for a display device, comprising; a signal controller that converts an input image signal input at a first frequency and corresponding to each pixel into first and second output image signals and alternately outputs the first and second output image signals at a second frequency higher than the first frequency: and a data driver that alternately applies the first and second output image signals to the pixel, wherein the first and second output image signals include an edge detection value for an image calculated based on a difference between the input image signals for the pixels, and wherein the first and second output image signals are determined through comparison of the image signal to an image signal in a previous frame.

When the pixel exists in an edge region of the image, the first and second output image signals may be different from each other, and when the pixel does not exist in the edge region of the image, the first and second output image signals may be equal to each other.

The first output image signal may be greater than the second output image signal.

The signal controller may compare the input image signal with the input image signal in the previous frame to convert the input image signal into a first preliminarily-compensated signal convert the input image signal into a second preliminarily-compensated signal including upper and lower signals or the first preliminarily-compensated signal into a third preliminarily-compensated signal including the upper and lower signals, and generate the first and second output signals based on the first and second preliminarily-compensated signals or the first and the third preliminarily-compensated signals.

A gray value of the lower signal may be zero.

When the input image signal is greater by a predetermined value than the input image signal in the previous frame, the first preliminarily-compensated signal may be greater than the input image signal.

The lower signal of the second preliminarily-compensated signal may be lower than the lower signal of the third preliminarily-compensated signal.

A sum of light intensities of the pixel due to the upper and lower signals of the third preliminarily-compensated signal may be equal to a light intensity of the pixel due to the first preliminarily-compensated signal.

The first and second output image signals $A_N$ and $B_N$ converted from the input image signal $I_N$ may satisfy $A_N=I_N'+\alpha_N(H_N-I_N')$ and $B_N=I_N'+\alpha_N(L_N-I_N')$, wherein $I_N'$ denotes the first preliminarily compensated signal $\alpha_N$ denotes an edge variable, and $H_N$ and $L_N$ denote the upper and lower signals of the second or third preliminarily-compensated signal respectively.

The signal controller may comprise; a frame memory that stores the input image signal in units of a frame; a row memory that stores the input image signal in units of a row; and an image signal compensating unit that receives the input image signal from the frame and row memories and generates the first and second output image signals.

The image signal compensating unit may comprise; a first preliminary compensating unit that converts the input image signal into the first preliminarily-compensated signal based on the input image signal in the previous frame; a second preliminary compensating unit that converts the input image signal or the first preliminarily-compensated signal into the second preliminarily-compensated signal; an edge detecting unit that detects the edge variable based on the input image signal; a calculating unit that calculates the first and second output image signals based on the first preliminarily-compensated signal, the upper signal of the second preliminarily-compensated signal the lower signal of the second preliminarily-compensated signal and the edge variable; and a multiplexer that alternately selects and outputs the first and second output image signals from the first calculating unit.

The edge detecting unit may comprise: a second calculating unit that calculates a difference in gray value between the pixels; and a scale adjusting unit that calculates the edge variable based on information on the difference in gray value received from the second calculating unit.

An exemplary embodiment of the present invention provides a method of compensating an image signal of a display device, comprising steps of; reading previous and current image signals of each pixel; compensating the current image signal based on the previous image signal to calculate a first preliminarily-compensated signal determining an upper or lower signal of a second preliminarily-compensated signal based on the input image signal or the first preliminarily-compensated signal; determining whether the pixel exists in an edge region of the image based on the current image signal: for the pixel that does not exist in the edge region of the image, outputting the first and second output image signals as the first preliminarily-compensated signal; and for the pixel that exists in the edge region of the image, alternately outputting the first and second image signals based on the first preliminarily-compensated signal the upper signal of the second preliminarily-compensated signal, the lower signal of the second preliminarily-compensated signal, and the edge variable, wherein a frame frequency of the output image signal is higher than, that of the current image signal.

The frame frequency of the output image signal may be twice the frame frequency of the current image signal.

The upper signal of the second preliminarily-compensated signal may be greater than the first preliminarily-compensated signal, and the lower signal of the second preliminarily-compensated signal may be smaller than the first preliminarily-compensated signal, and wherein a sum of light intensities of the pixel due to the upper and lower signals of the second preliminarily-compensated signal is substantially equal to a light intensity of the pixel due to the first preliminarily-compensated signal.

A gray value of the lower signal may be zero.

When the input image signal is greater by a predetermined value than the input image signal, of the previous frame, the first preliminarily-compensated signal may be greater than the input image signal.

The first output image signal may be greater than the second output image signal.

The first and second output image signals $A_N$ and $B_N$ converted from the input image signal $I_N$ may satisfy $A_N=I_N'+\alpha_N(H_N-I_N')$ and $B_N=I_N'+\alpha_N(L_N-I_N')$ wherein $I_N'$ denotes the first preliminarily-compensated signal. $\alpha_N$ denotes an edge variable, and $H_N$ and $L_N$ denote the upper and lower signals of the second preliminarily-compensated signal, respectively.

BRIEF DESCRIPTION OF THE DRAWINGS

Exemplary embodiments of the present invention will be understood in more detail from the following descriptions taken in conjunction with the attached drawings.

FIG. 4 is a view showing a lookup table in an example of a first preliminary compensating unit of the signal controller shown in FIG. 3.

FIG. 8 is a view showing a lookup table in an example of a second preliminary compensating unit of the signal controller shown in FIG. 3.

FIGS. 11A and 11B are views showing X-direction and Y-direction filters of the edge detecting unit shown in FIG. 10, respectively.

FIGS. 17A and 17B are views showing lookup tables in examples of the third preliminary compensating unit of the signal controller shown in FIG. 15.

DETAILED DESCRIPTION OF EXEMPLARY EMBODIMENTS

The present invention will be described more fully hereinafter with reference to the accompanying drawings, in which exemplary embodiments of the invention are shown. As those skilled in the art would realize, the described exemplary embodiments may be modified in various different ways, all without departing from the spirit or scope of the present invention.

A driving device for a display device and an image signal compensating method thereof according to exemplary embodiments of the present invention will be described in detail with reference to FIGS. 1 and 2.

Figure 1:
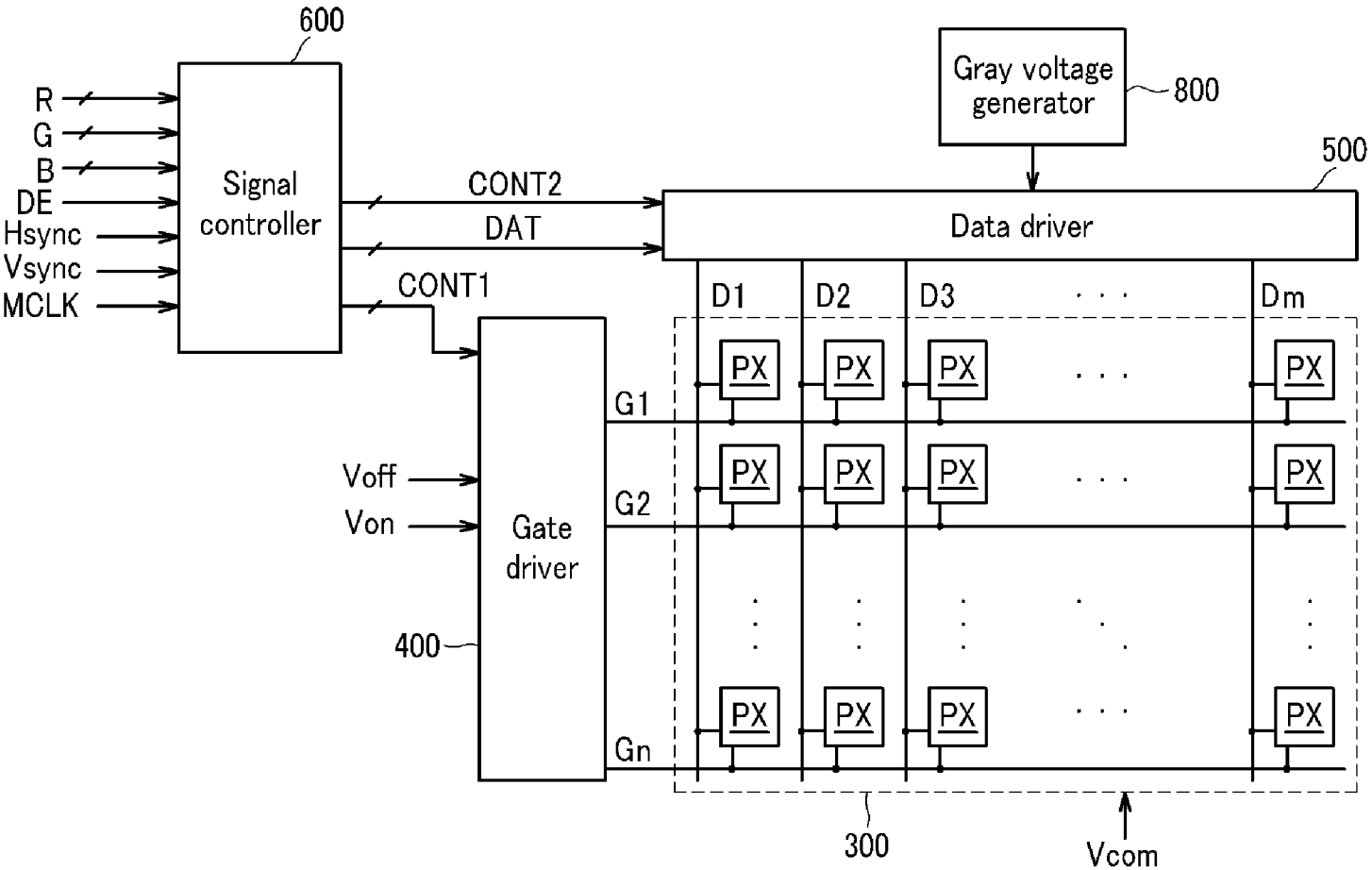
FIG. 1 is a block diagram showing a liquid crystal display according to an exemplary embodiment of the present invention.
Figure 2:
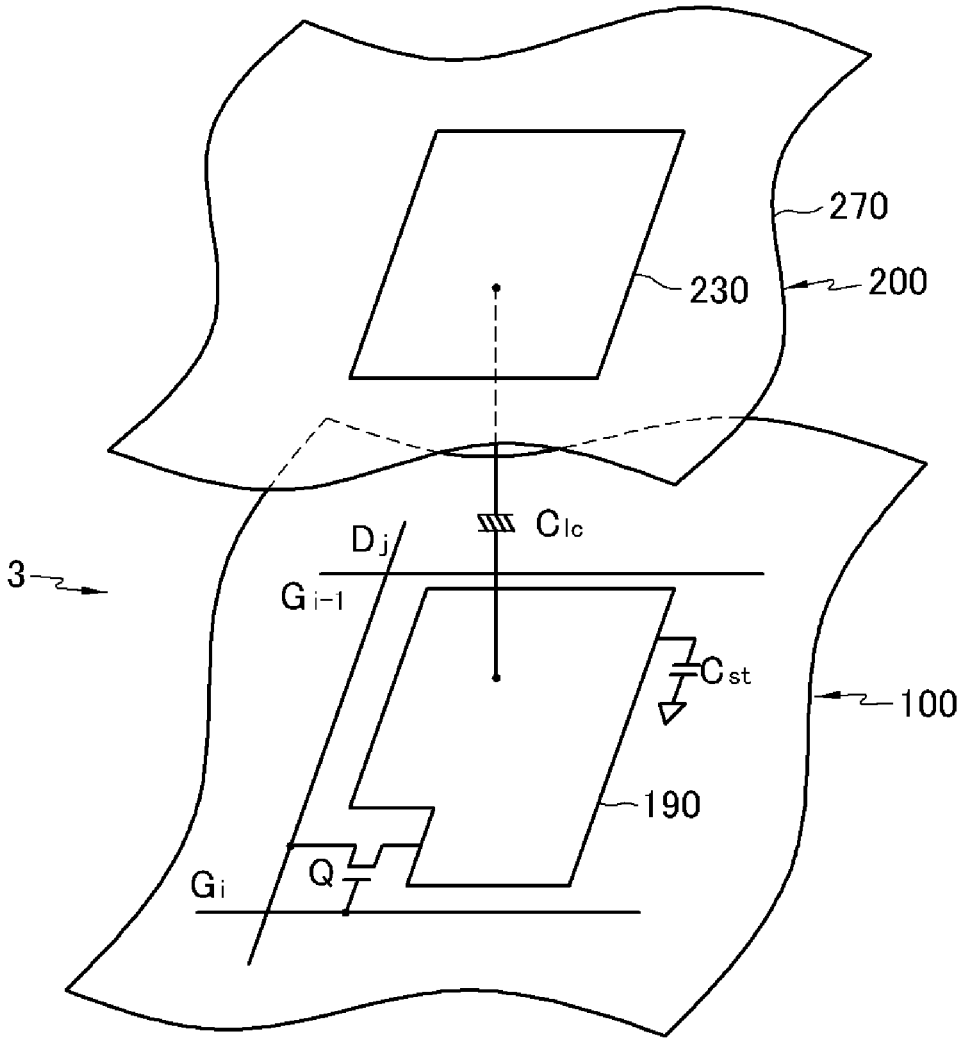
FIG. 2 is an equivalent circuit diagram showing one pixel of a liquid crystal display according to an exemplary embodiment of the present invention.

FIG. 1 is a block diagram showing a liquid crystal display according to an exemplary embodiment of the present invention. FIG. 2 is an equivalent circuit diagram showing one pixel of a liquid crystal display according to an exemplary embodiment of the present invention.

Referring to FIG. 1, the liquid crystal display according to the exemplary embodiment of the present invention includes a liquid crystal panel assembly 300, a gate driver 400, a data driver 500, a gray voltage generator 800, and a signal controller 600 controlling the above elements.

The liquid crystal panel assembly 300 includes a plurality of signal lines $G_1$ to $G_n$ and $D_1$ to $D_m$ and a plurality of pixels PXs, which are connected to the signal lines and arranged approximately in matrix form, in terms of an equivalent circuit. The liquid crystal panel assembly 300 includes lower and upper display panels 100 and 200 facing each other and a liquid crystal layer 3 interposed therebetween with reference to the structure shown in FIG. 2.

The signal lines $G_1$ to $G_n$ and $D_1$ to $D_m$ include a plurality of gate lines $G_1$ to $G_n$ transmitting gate signals (also referred to as scan signals) and a plurality of data lines $D_1$ to $D_m$ transmitting data signals. The gate lines $G_1$ to $G_n$ extend in an approximate row direction and are generally parallel to each other, and the data lines $D_1$ to $D_m$ extend in a column direction and are also generally parallel to each other.

Each pixel, for example, a pixel PX which is connected to an i-th (i=1, 2, . . . , n) gate line $G_i$ and a j-th (j=1, 2, . . . , m) data line $D_j$, includes a switching device Q that is connected to signal lines ($G_i$ $D_j$), a liquid crystal capacitor Clc that is connected to the switching device Q, and a storage capacitor Cst. The storage capacitor Cst may be omitted if desired.

The switching element Q is a three terminal element, such as a thin film transistor, disposed on the lower panel 100. Each switching element Q has a control terminal connected to the gate line G, an Input terminal connected to the data line $D_j$, and an output terminal connected to the liquid crystal capacitor Clc and the storage capacitor Cst.

The liquid crystal capacitor Clc uses a pixel electrode 190 of the lower panel 100 and a common electrode 270 of the upper panel 200 as its two terminals, and the liquid crystal layer 3 interposed between the two electrodes 190 and 270 serves as the dielectric material of the capacitor. The pixel electrode 191 is connected to the switching element Q, and the common electrode 270 is disposed on the entire surface of the upper panel 200 and supplied with a common voltage Vcom. Unlike the common electrode 270 shown in FIG. 2, the common electrode 270 may alternatively be disposed on the lower panel 100. In this case, at least one of the two electrodes 190 and 270 may be formed in the shape of a line or a bar.

The storage capacitor Cst having an auxiliary capacitor for the liquid crystal capacitor Clc is constructed by overlapping each of separate lines (not shown) disposed on the lower panel 100 and each of the pixel electrodes 190 with an insulator interposed therebetween, wherein and each of the separate signal lines is applied with a predetermined voltage, such as a common voltage Vcom. Alternatively, the storage capacitor Cst may be constructed by overlapping the pixel electrode 190 and an adjacent gate line, referred to as a previous gate line, G.sub.i−1 with the insulator interposed therebetween.

On the other hand, in order to implement color display, each of the pixels PX uniquely displays one of the primary colors (spatial division), or each of the pixels PX alternately displays the primary colors according to time (temporal division). As a result, a desired color can be obtained by a spatial or temporal, combination of the primary colors. As an example of the primary colors, there is the set of three primary colors such as red, green, and blue. FIG. 2 shows an example of the spatial division. As shown in the FIG., each of the pixels PX includes a color filter 230 for representing one of the primary colors, which is provided to a region of the upper panel 200 corresponding to the pixel electrode 190. Unlike the color filter 230 shown in FIG. 2, the color filter 230 may alternatively be provided above or below the pixel electrode 190 of the lower panel 100.

At least one polarizer (not shown) for polarizing light is attached on an outer surface of the liquid crystal panel assembly 300.

Referring again to FIG. 1, the gray voltage generator 800 generates the entire set of gray voltages or a limited number of gray voltages (hereinafter, referred to as reference gray voltages) that are related to the light transmittance of the pixels PXs. The (reference) gray voltage may include a voltage that is positive or negative with respect to the common voltage Vcom.

The gate driver 400 is connected to the gate lines $G_1$ to $G_n$ of the liquid crystal panel assembly 300. The gate driver 400 synthesizes a gate-on voltage Von and a gate-off voltage Voff to generate the gate signals for application to the gate lines $G_1$-$G_n$.

The data driver 500 is connected to the data lines $D_1$ to $D_m$ of the liquid crystal panel assembly 300. The data driver 500 selects a gray voltage generated by the gray voltage generator 800 and applies the selected gray voltage to the data lines $D_1$ to $D_m$ as data signals. Alternatively, in the case where the gray voltage generator 800 applies a predetermined number of reference gray voltages but not voltages for the entire set of gray voltages, the image data driver 500 divides the reference gray voltages and selects the desired image data signal.

The signal controller 600 controls the gate driver 400, the data driver 500, and the like.

The units 400, 500, 600, and 800 may be mounted in the form of one IC chip directly on the liquid crystal panel assembly 300. Alternatively, the individual units may be mounted on a flexible printed circuit film (not shown) and attached in a form of a tape carrier package (TCP) on the liquid crystal panel assembly 300. As another alternative, the drivers may be mounted on a separate printed circuit board (PCB) (not shown). As still another alternative, the units 400, 500, 600, and 800 together with the signal lines $G_1$ to $G_n$ and $D_1$ to $D_m$) and the thin film transistor switching elements Q may be integrated on the liquid crystal panel assembly 300. In addition, the units 400, 500, 600, and 800 may be integrated in the form of a single chip. In this case, at least one of the units or at least one circuit element constituting the units may be disposed outside of the single chip.

The operations of the liquid crystal display device will now be described in detail.

The signal controller 600 is supplied with input image signals R, G, and B and input control signals for controlling display of the input image signals R, G, and B supplied from an external graphic controller (not shown). The input image signals R, G, and B include information on the luminance of each pixel PX. The luminance has a predetermined number of gray values, for example, 1024(=$2^{10}$), 256(=$2^8$), or 64(=$2^6$) gray values. As an example of the input control signal there are a vertical synchronization signal Vsync, a horizontal synchronization signal Hsync, a main clock MCLK, and a data enable signal DE.

The signal controller 600 processes the input image signals R, G, and B according to an operating condition of the liquid crystal panel assembly 300 based on the input image signals R, G, and B and the input control signals to generate a gate control signal CONT1 a data control signal CONT2, and the like. Then, the signal controller 600 outputs the generated gate control signal CONT1 to the gate driver 400 and outputs the generated data control signal CONT2 and the processed image signal DAT to the data driver 500.

The gate control signal CONT1 includes a scan, start signal that is used for indicating a scan start and at least one clock signal that is used for controlling an output period of the gate-on voltage Von. The gate control signal CONT1 may further include an output enable signal for limiting a duration time of the gate-on voltage Von.

The data control signal CONT2 includes a horizontal synchronization start signal that is used for indicating initiation of data transmission for a row of pixels PXs, a load signal that is used for requesting to apply data signals to the data lines $D_1$ to $D_m$, and a data clock signal. The data control signal CONT2 may further include a reverse signal that is used for inverting a voltage polarity of the data signal with respect to the common voltage Vcom (hereinafter, the voltage polarity of the data signal, with respect to the common voltage is referred to as a polarity of the data signal).

The data driver 500 receives the digital image signals DAT for a row of pixels PX according to the data control signal CONT2 transmitted from the signal controller 600 and selects a gray voltage corresponding to each digital image signal DAT to convert the digital image signals DAT into analog data signals. Thereafter, the data driver 500 applies the converted analog data signals to the corresponding data lines $D_1$ to $D_m$.

The gate driver 400 applies a gate-on voltage Von to the gate lines $G_1$ to $G_n$ according to the gate control signal CONT1 transmitted from the signal controller 600 to turn-on switching devices Q connected to the gate lines $G_1$ to $G_n$. Then, the data signals applied to the data lines $D_1$ to $D_m$ are applied to corresponding pixels PX through the turned-on switching devices Q.

A difference between the date voltage applied to the pixel PX and the common voltage Vcom is represented as a voltage charged in the liquid crystal capacitor Clc, that is, a pixel voltage. Alignment of the liquid crystal molecules varies according to the magnitude of the pixel voltage to change the polarization of light passing through the liquid crystal layer 3. The transmittance of the light is changed by a polarizer attached to the liquid crystal panel assembly 300 according to the change in the polarization, so that the pixel PX can display luminance represented by the gray values of the image signal DAT.

In units of one horizontal period (or 1H), that is, one period of the horizontal synchronization signal Hsync and the data enable signal DE, the aforementioned operations are repetitively performed to sequentially apply the gate-on voltages Von to all the gate lines $G_1$ to $G_n$, so that the data signals are applied to all the pixels PX. As a result one frame of an image is displayed.

When one frame ends, the next frame starts, and a state of the inversion signal (not shown) applied to the data driver 500 is controlled so that the polarity of the data signal applied to each of the pixels is opposite to the polarity in the previous frame (frame inversion). At this time, even in one frame, according to the characteristics of the inversion signals, the polarity of the data signal flowing through the one data line may be inverted (row inversion, dot inversion), and the polarities of the data signals applied to one pixel row may be different from each other (column inversion, dot inversion).

A signal controller according to an exemplary embodiment of the present invention is described in detail with reference to FIG. 3.

Figure 3:
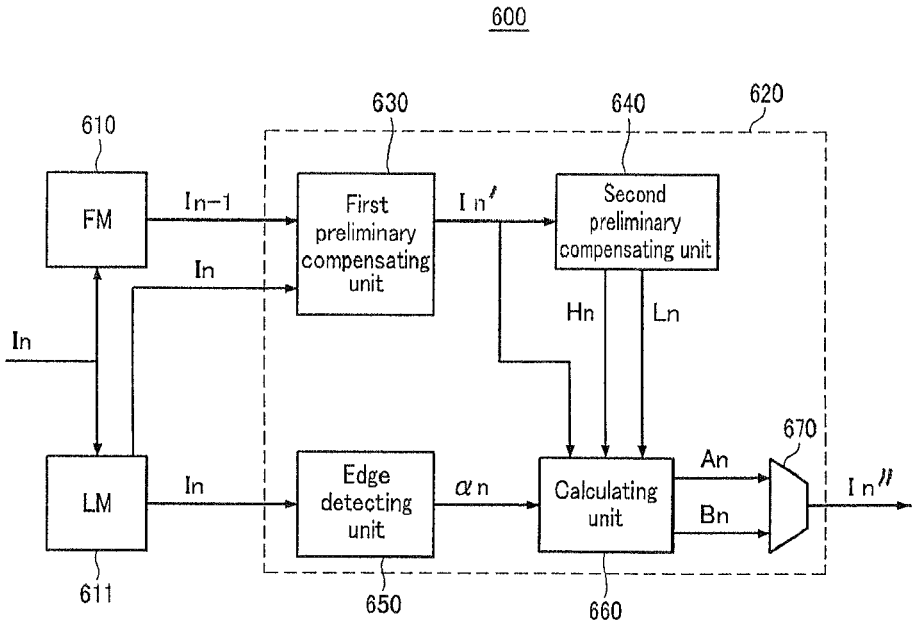
FIG. 3 is a block diagram showing a signal controller according to another exemplary embodiment of the present invention.

FIG. 3 is a block diagram showing a signal controller according to an exemplary embodiment of the present invention.

Referring to FIG. 3, the signal controller according to the exemplary embodiment includes a frame memory (FM) 610, a row memory (LM) 611, and an image signal compensating unit 620.

The frame memory 610 stores an input image signal forming a frame.

The row memory 611 stores an input image signal forming a plurality of rows.

The image signal compensating unit 620 receives image signals $I_N$ and $I_{N-1}$ for one pixel PX in different frames, that is, N-th and (N−1)-th frames from the frame memory 610 and the row memory 611, respectively. The image signal compensating unit 620 converts the image signal $I_N$ into a first preliminarily-compensated signal $I_N'$ and, in turn, converts the first preliminarily-compensated signal $I_N'$ to a pair of the second preliminarily-compensated signals $H_N$ and $L_N$. On the other hand, the image signal compensating unit 620 calculates an edge variable $\alpha_N$. The image signal compensating unit 620 generates first and second output image signals $A_N$ and $B_N$ based on the edge variable $\alpha_N$. The image signal compensating unit 620 alternately outputs the first and second output image signals and as an output image signal $I_N''$. The first preliminarily-compensated signal $I_N'$ is generated such that the data voltage applied to the pixel PX will be smaller or greater than a target data voltage through dynamic-capacitance compensation (DCC). The second preliminarily-compensated signals $H_N$ and $L_N$ correspond to different data voltages that are to be subsequently applied to one pixel PX. The edge variable $\alpha_N$ is generated according to presence and absence of the edge in the displayed image.

The image signal compensating unit 620 includes a first preliminary compensating unit 630 that generates the first preliminarily-compensated signal $I_N'$, a second preliminary compensating unit 640 that generates the second preliminarily-compensated signals $H_N$ and $L_N$, an edge detecting unit 650 that generates the edge variable $\alpha_N$, a calculating unit 660, and a multiplexer 670.

The first preliminary compensating unit 630 generates the first preliminarily-compensated signal $I_N'$ based on the image signal $I_N$ received from the row memory 611 and the image signal $I_{N-1}$ received from the frame memory 610. The image signal $I_{N-1}$ received from the frame memory 610 is an image signal for the last frame before the image signal $I_N$ received from the row memory 611. Hereinafter, the image signal $I_N$ received from the row memory 611 is referred to as a "current image signal", and the image signal $I_{N-1}$ received from the frame memory 610 is referred to as a "previous image signal".

The generation, of the first preliminarily-compensated signal $I_N'$ is described in detail with reference to FIG. 4.

When a voltage is applied across two terminals of the liquid crystal capacitor Clc, the liquid crystal molecules in the liquid crystal layer 3 have a tendency to be reoriented into a stable state according to the voltage. Since a response speed of the liquid crystal molecules is slow, a finite amount of time is spent on approaching the stable state. When the voltage applied to the liquid crystal capacitor Clc is continuously maintained, the liquid crystal molecules move until the liquid crystal molecules approach the stable state. Therefore, the light transmittance also varies. When the liquid crystal molecules approach, the stable state, the liquid crystal molecules stop their reorientation, so that the light transmittance becomes fixed.

When a pixel voltage in such a stable state is referred to as a target pixel voltage and a light transmittance in the stable state is referred to as target light transmittance, the target pixel voltage and the target light transmittance have a direct correspondence.

When a switching element Q of the pixel PX is turned on, a time for applying the data voltage is limited. Therefore, during the limited time for applying the data voltage, it is difficult for the liquid crystal molecules to approach the stable state. In addition, although the switching element Q is turned off, a voltage difference still remain across the two terminals of the liquid crystal capacitor Clc, so that the liquid crystal molecules continue to move so as to approach the stable sate. Accordingly, when the alignment of the liquid crystal molecules changes, the dielectric constant of the liquid crystal layer 3 varies and, thus, the capacitance of the liquid crystal capacitor Clc varies. In the state that the switching element Q is turned off one of the terminals of the liquid crystal capacitor Clc is in the floating state. Therefore, if a leakage current is negligible, a total charge stored in the liquid crystal capacitor Clc is maintained constant. As a result, a change in capacitance of the liquid crystal capacitor Clc causes a change in voltage across the two terminals of the liquid crystal capacitor Clc, that is, the pixel voltage.

Therefore, if a data voltage (the aforementioned target data voltage) corresponding to the target pixel voltage that is based on the stable state is directly applied to the pixel PX, an actual pixel voltage is different from the target pixel voltage, so that target transmittance cannot be obtained. Particularly, the greater the difference between the target transmittance and the transmittance of the pixel PX is, the greater the difference between, the actual pixel voltage and the target pixel voltage is.

Therefore, there is a need to adjust the data voltage applied to the pixel PX to be higher or lower than the target data voltage. The aforementioned DCC is one of the methods of adjusting the data voltage.

In the exemplary embodiment, the DCC is performed by the signal controller 600. A current image signal $I_N$ for an arbitrary pixel PX is compensated based on the previous image signal $I_{N-1}$, that is, an image signal in the last frame for the pixel PX to generate the first preliminarily-compensated signal $I_N'$. The first preliminarily-compensated signal $I_N'$ is basically determined based on experimental results. In general, a difference between the first preliminarily-compensated signal $I_N'$ and the previous image signal $I_{N-1}$ is greater than a difference between the before-compensated signal, that is, the current image signal $I_N$ and the previous image signal $I_{N-1}$. If the current image signal $I_N$ and the previous image signal $I_{N-1}$ are equal to each other or slightly different from each other, however, the first preliminarily-compensated signal $I_N'$ may be equal to the current image signal $I_N$. In this case, that is, the current image signal may not be modified.

The first preliminarily-compensated signal $I_N'$ may be represented by a function F1 as shown in the following Equation 1.

$$I_N' = F1(I_N, I_{N-1}) \quad \text{(Equation 1)}$$

In this manner, in the data driver 500, the date data voltage applied to each pixel PX can be adjusted so as to be higher or lower than the target data voltage.

In order to obtain the first preliminarily-compensated signal $I_N'$, the first preliminary compensating unit 630 may further include a lookup table (not shown). In the lookup table, the first preliminarily-compensated signals $I_N'$ are stored so as to correspond to pairs of the current and previous image signals $I_{N-1}$ and $I_N$.

If all the first preliminarily-compensated signal $I_N'$ corresponding to all the pairs of the current and previous image signals $I_{N-1}$ and $I_N$ are stored, a large-sized lookup table is needed. Therefore, some first preliminarily-compensated signals $I_N'$ corresponding to only a few pairs of the previous and current image signal $I_{N-1}$ and $I_N$ are stored as reference compensated image signals, and other first preliminarily-compensated signals $I_N'$ corresponding to the remaining pairs of previous and current image signals $I_{N-1}$ and $I_N$ are obtained through interpolation.

FIG. 4 shows an example of the lookup table listing the first preliminarily-compensated signals $I_N'$ corresponding to a few pairs of the first and second preliminarily-compensated signals $I_{N-1}$ and $I_N$ in case of 256-gray values. In FIG. 4, the interpolation of pairs of previous and current image signals $I_{N-1}$ and $I_N$ is performed by obtaining reference compensated image signals for image signal pairs ($I_{N-1}$, $I_N$) identifying peripheral image signal pairs ($I_{N-1}$, $I_N$) and calculating the first preliminarily-compensated signal $I_N'$ for the image signal pairs ($I_{N-1}$, $I_N$) based on the reference compensated image signals.

For example, the digital image signals $I_{N-1}$ and $I_N$ are divided into upper and lower bits, and the reference compensated image signal corresponding to the pairs of the previous and current image signals $I_{N-1}$ and $I_N$ having the lower bit 0 is stored in the lookup table. For an arbitrary pair of the previous and current image signals $I_{N-1}$ and $I_n$, the reference compensated image signals are searched in the lookup table based on the upper bits. Next, the first preliminarily-compensated signal $I_N'$ is calculated by using the lower bits of the previous and current image signals $I_{N-1}$ and $I_N$ and the reference compensated image signals obtained from the lookup table.

The interpolation is described in more detail with reference to FIG. 5.

Figure 5:
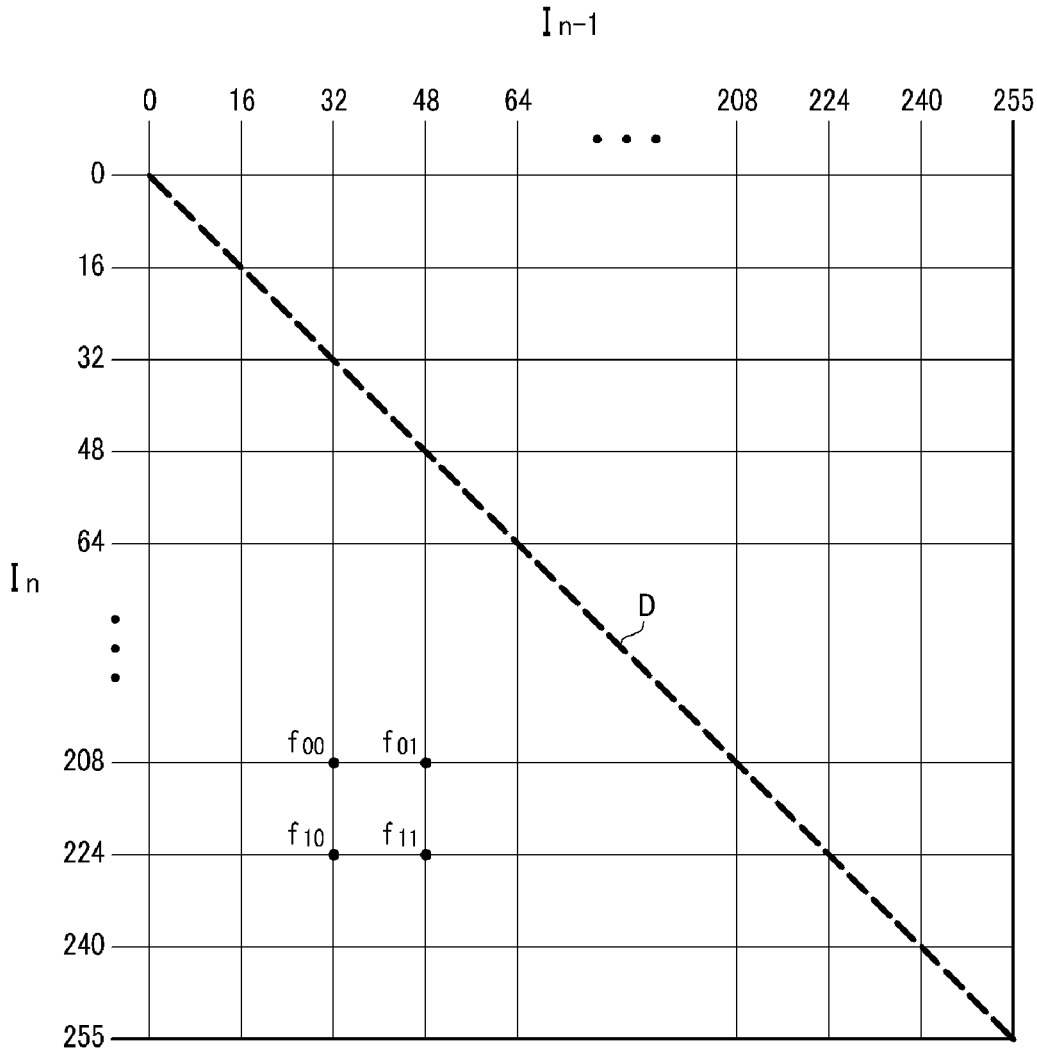
FIG. 5 is a view for explaining a method of determining an output image signal in the signal controller shown in FIG. 3.

FIG. 5 is a view for explaining an example of calculating the first preliminarily-compensated signal through interpolation in a liquid crystal display according to an exemplary embodiment of the present invention.

An input image signal is constructed with x upper bits and y lower bits. For example, in case of an 8-bit image signal, the number of upper bits may be 4 or 3. When the number of upper bits is 4, only the output image signal corresponding to 17×17 input image signal pairs are stored. When the number of upper bits is 3, only the output image signal corresponding to 9×9 input signal pairs are stored. As shown in FIG. 5, in case of the 8-bit image signal, when the number of upper bits is 4, the previous and current image signals $I_{N-1}$ and $I_N$ are disposed in horizontal and vertical axes, respectively.

in FIG. 5, squares partitioned by solid lines are blocks partitioned based on the upper bits of the previous and current image signals $I_{N-1}$ and $I_N$. At the points in the edge of the block, the lower bit of the previous or current image signal $I_{N-1}$ or $I_N$ is 0. At the internal points of the block, the upper bits of the previous and current image signals $I_{N-1}$ and $I_N$ are equal to each other. In addition, at the points of the left and upper sides, the upper bits thereof are equal to the upper bits of the internal points of the block. At the points of the right and lower sides, however, the upper bits thereof are different from the upper bits of the internal points of the block.

Vertexes of the block are provided with output image signals that are referred to as reference data f. For example, in FIG. 5, four vertexes defining one block are provided with output image signals $f_{00}$, $f_{01}$, $f_{10}$, and $f_{11}$. The output image signals provided to points excluding the vertexes can be calculated as a function of the lower bits.

Returning to FIG. 3, the second preliminary compensating unit 640 receives the first preliminarily-compensated signal $I_N'$ from the first preliminary compensating unit 630 and converts the first preliminarily-compensated signal $I_N'$ into a pair of the second preliminarily-compensated signals $H_N$ and $L_N$. The second preliminarily-compensated signals $H_N$ and $L_N$ include an upper signal $H_N$ and a lower signal $L_N$.

The second preliminary compensating unit 640 is described in detail with reference to FIGS. 6 to 8.

Figure 6:
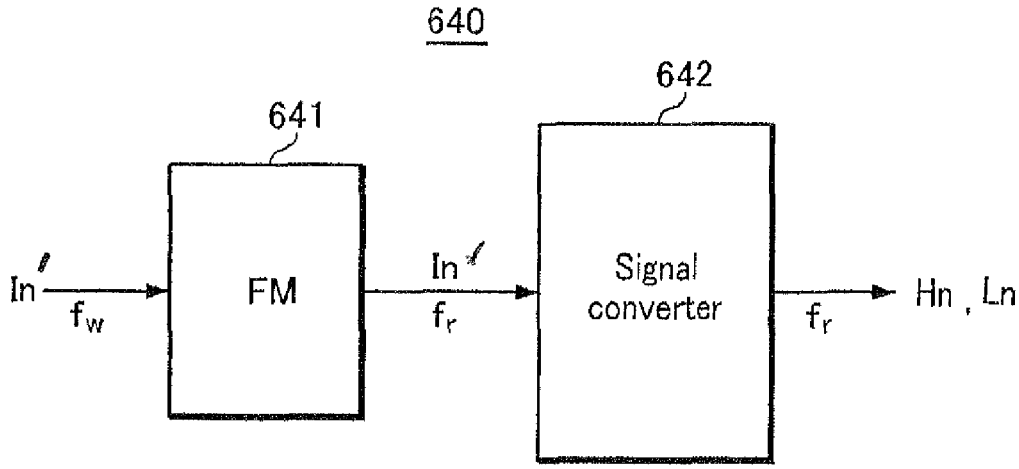
FIG. 6 is a block diagram showing a second preliminary compensating unit of the signal controller shown in FIG. 3.

FIG. 6 is a block diagram showing a second preliminary compensating unit in a liquid crystal display according to an exemplary embodiment of the present invention. FIG. 7 is a graph showing a gamma curve for a first preliminarily-compensated signal $I_{N'}$ and second preliminarily-compensated signals $H_N$ and $L_N$. FIG. 8 is a view showing an example of a lookup table listing pairs of lower and upper signals $L_N$ and $H_N$ corresponding to the first preliminarily-compensated signal $I_{N'}$ in case of 256-gray values.

Referring to FIG. 6, the second preliminary compensating unit 640 includes a frame memory 641 and a signal converter 642 connected thereto.

The frame memory 641 stores the first preliminarily-compensated signal $I_N'$ input from the first preliminary compensating unit 630.

The signal converter 642 sequentially receives the first preliminarily-compensated signals $I_N'$ stored In the frame memory 641 and converts each of the first preliminarily-compensated signals $I_N'$ into the second preliminarily-compensated signals $H_N$ and $L_N$ including the upper and lower signals $H_N$ and $L_N$. More specifically, the signal converter 642 reads the first preliminarily-compensated signals $I_N'$ one by one to convert the first preliminarily-compensated signals $I_N'$ into one of the upper and lower signals $H_N$ and $L_N$ and sequentially outputs the converted signal. Next, the signal converter 642 reads the first preliminarily-compensated signals $I_N'$ to convert the first preliminarily-compensated signal $I_N'$ into the other and sequentially outputs the converted signal.

Since the first preliminarily-compensated signal $I_N'$ stored in the frame memory 641 is read twice, a read frequency fr (or an output frequency) of the frame memory 641 is twice a write frequency fw (or input frequency). Therefore, if an input frame frequency fw of the frame memory 641 is 60 Hz, an output field frequency of the image signal compensating unit 620 and a data-voltage applying frequency are both 120 Hz.

Figure 7:
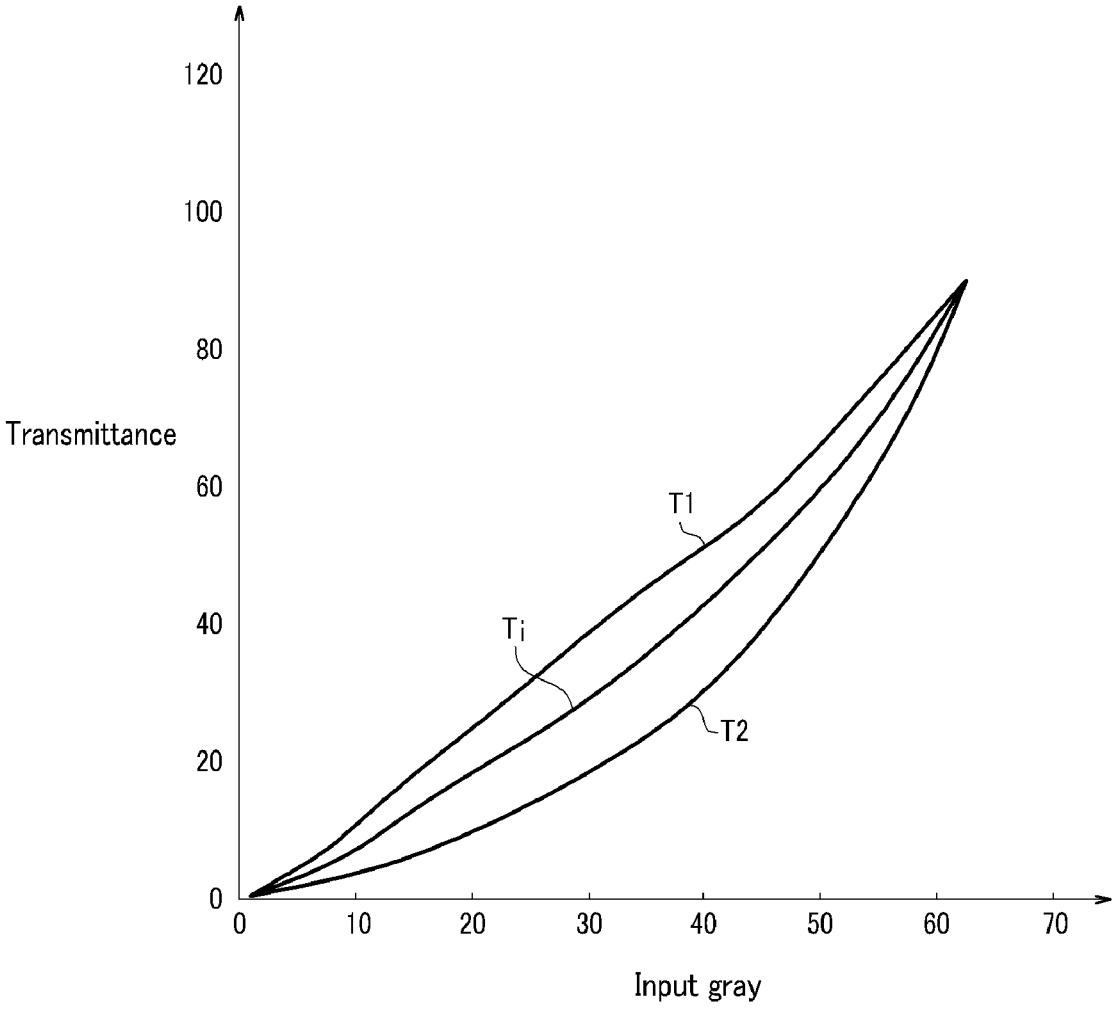
FIG. 7 is a graph showing a gamma curve for a second preliminarily-compensated signal in the signal controller shown in FIG. 3.

FIG. 7 shows gamma curves Ti, T1, and T2 corresponding to the first preliminarily-compensated signal $I_N'$, the upper signal $H_N$, and the lower signal $L_N$. The average of the gamma curves T1 and T2 corresponding to the upper and lower signals $H_N$ and $L_N$ is equal to the gamma curve T corresponding to the first preliminarily-compensated signal $I_N'$.

In other words, a sum of the light intensities of a pixel due to the upper and lower signals $H_N$ and $L_N$ is equal to a light intensity of the pixel due to the first preliminarily-compensated signal $I_N'$. The light intensity denotes a product of the luminance and a time for maintaining the luminance.

When values of the luminance corresponding to the first preliminarily-compensated signal $I_N'$, the upper signal $H_N$, and the lower signal $L_N$ are denoted by $T(I_N')$, $T(H_N)$, and $T(L_N)$, respectively. Equation 2 is obtained as follows.

$$2T(I_N')=T(H_N)+T(L_N) \quad \text{(Equation 2)}$$

FIG. 8 shows an example of a lookup table listing pairs of lower and upper signals $L_N$ and $H_N$ corresponding to the first preliminarily-compensated signal $I_N'$ in case of 256-gray values.

Voltages applied to a pixel when the first and second preliminarily-compensated signals $I_N'$, $H_N$, and $L_N$ are transmitted to the data driver 500 are described in detail with reference to FIG. 9.

Figure 9:
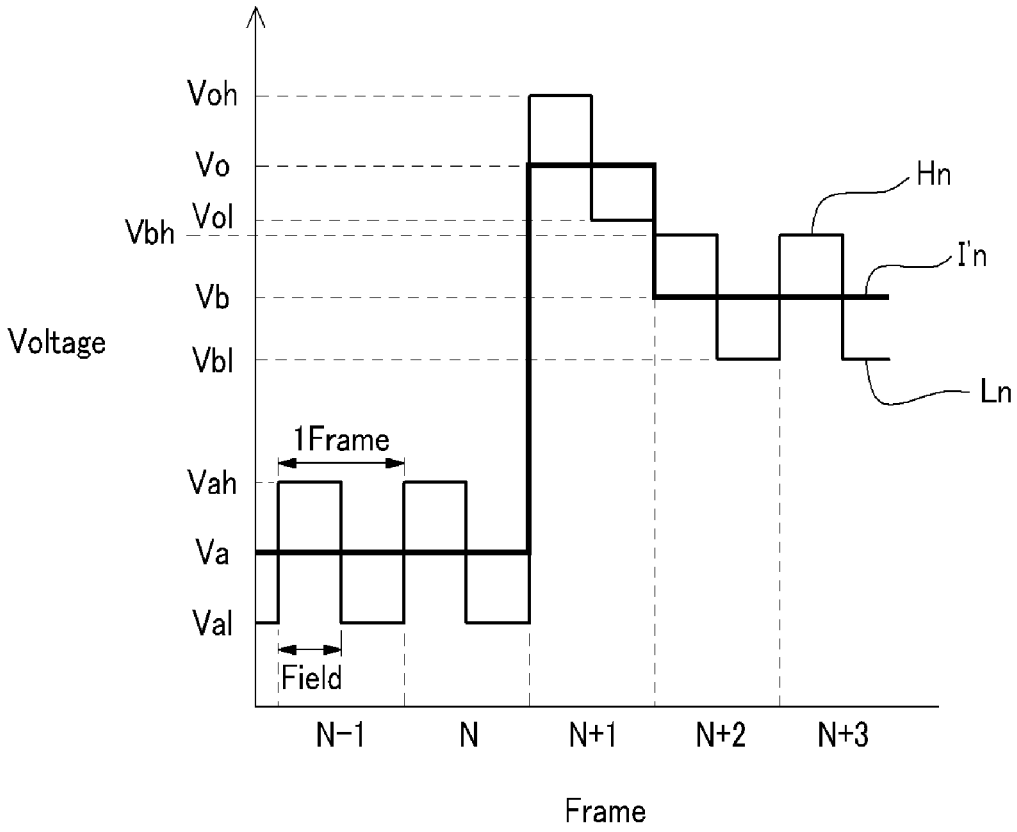
FIG. 9 is a graph showing a change in voltage with respect to time in a liquid crystal display that employs the first and second preliminary compensating units of the signal controller shown in FIG. 3.

FIG. 9 is a graph showing data voltages corresponding to the first preliminarily-compensated signal and the second preliminarily-compensated signals in a liquid crystal display according to an exemplary embodiment of the present invention.

In FIG. 9, the horizontal axis denotes time in units of frames, and the vertical axis denotes data voltages as absolute values. The input image signals in the (N−1)-th and N-th frames are equal to each other and correspond to an initial voltage Va. The input image signals in the (N+1)-th, (N+2)-th, and (N+3)-th frames are equal to each other and correspond to a target voltage Vb. The input image signal in the N-th frame is quite different from that in the (N+1)-th frame.

The first preliminary compensating unit 630 generates the first preliminarily-compensated signal $I'_{N-1}$ that provides a data voltage Vo higher than the target voltage Vb in the (N+1) frame based on the difference between the input image signals in the N-th and (N+1)-th frames. Since the input image signals in the N-th, (N+2)-th, and (N+3)-th frames are equal to each other, the first preliminarily-compensated signals $I'_N$ in the N-th and (N+2)-th frames are equal to the corresponding input image signals.

As a result, the data voltage generated when the first preliminarily-compensated signal $I_{N-1}'$ transmitted to the data driver 500 can be represented by a bold solid line in FIG. 9.

For all the frames, the second preliminary compensating unit 640 of FIG. 3 converts the first preliminarily-compensated signal $I'_N$ into the second preliminarily-compensated signals $H_N$ and $L_N$ including the upper and lower signals $H_N$ and $L_N$. As denoted by a thin solid line in FIG. 9, in the liquid crystal display, one frame is divided into two fields. During one field, a data voltage corresponding to the upper signal $H_N$ is applied to the pixel, and during the other field, a data voltage corresponding to the lower signal $L_N$ is applied to the pixel. More specifically, in the (N−1)-th and N-th frames, the upper and lower data voltages Vah and Val are applied to the pixel in units of a field. In the (N+1)-th frame, the upper and lower data voltages Voh and Vol are applied to the pixel in units of a field, and in the (N+1)-th and (N+2)-th frames, the upper and lower data voltages Vbh and Vbl are applied to the pixel in units of a field, in the exemplary embodiment, the upper data voltages Vah, Voh, and Vbh correspond to the upper signals $H_N$ of the second preliminarily-compensated signal, and the lower data voltages Val, Vol, and Vbl correspond to the lower signals $L_N$ of the second preliminarily-compensated signal.

On the other hand, when the lower signal $L_N$ is designed to be 0, or approximately 0, an impulsive driving effect can be obtained.

Referring again to FIG. 3, the edge detecting unit 650 measures a difference in luminance between the pixels so as to detect an edge in the displayed image. More specifically, the edge detecting unit 650 receives the image signal $I_N$ for the pixel and the peripheral pixels from the row memory 611 and calculates the edge variable $\alpha_N$.

The edge detecting unit 650 according to an exemplary embodiment of the present invention is described in detail with reference to FIGS. 10 to 13B.

Figure 10:
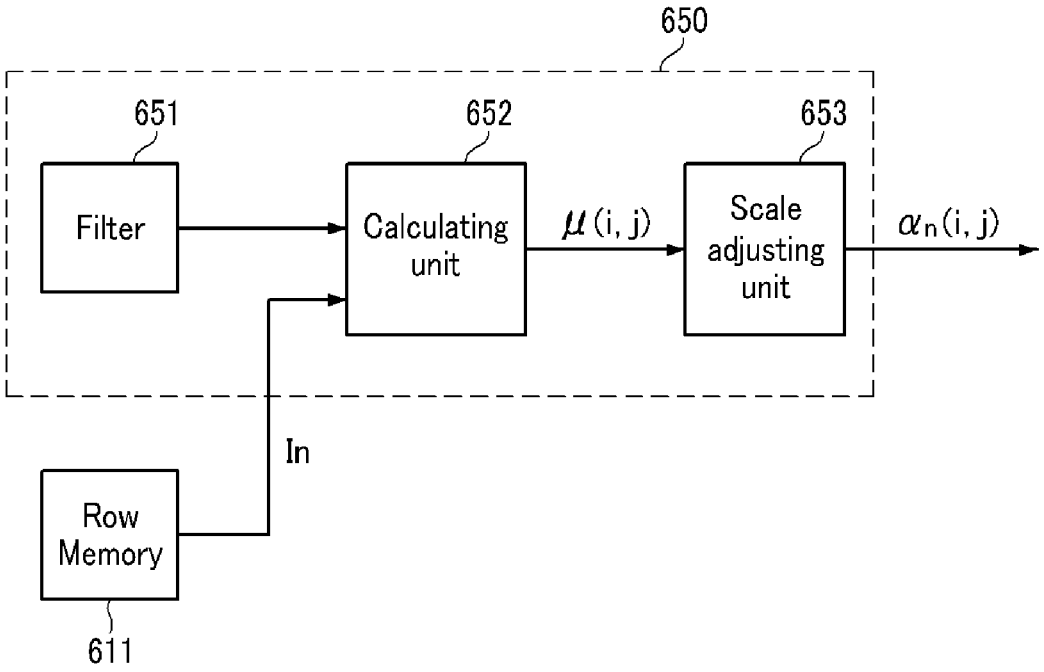
FIG. 10 is a block diagram showing an example of an edge detecting unit of the signal controller shown in FIG. 3.
Figure 12A:
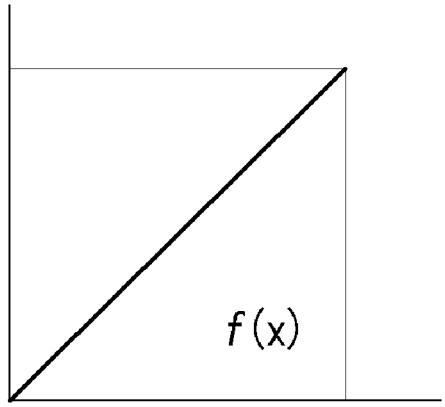
FIGS. 12A to FIG. 12E are graphs showing examples of operations of a scale adjusting unit in the edge detecting unit shown in FIG. 10.
Figure 12B:
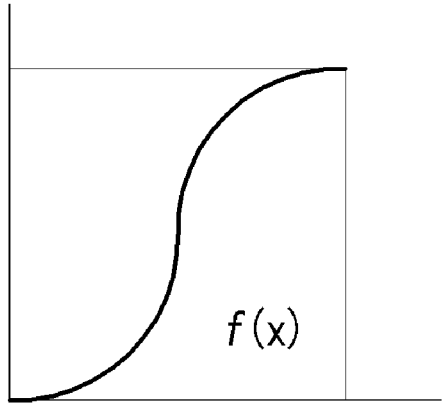
Figure 12C:
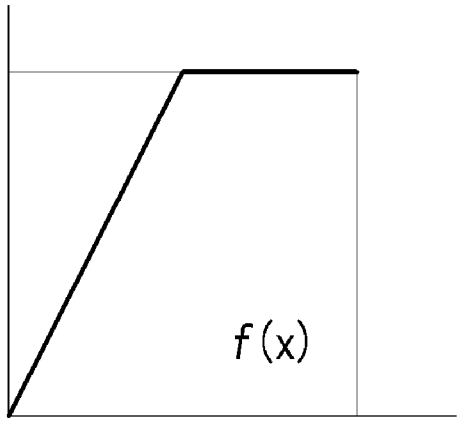
Figure 12D:
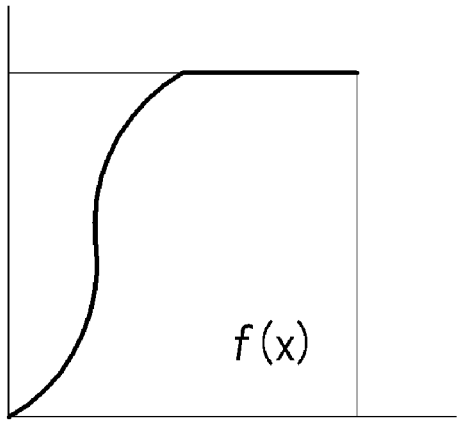
Figure 12E:
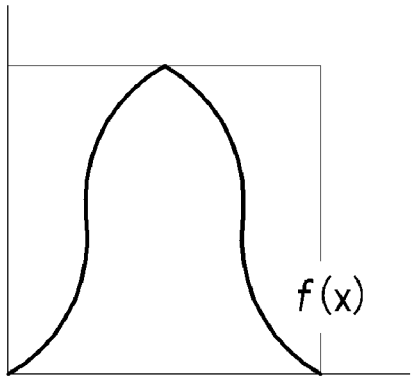
Figure 13A:
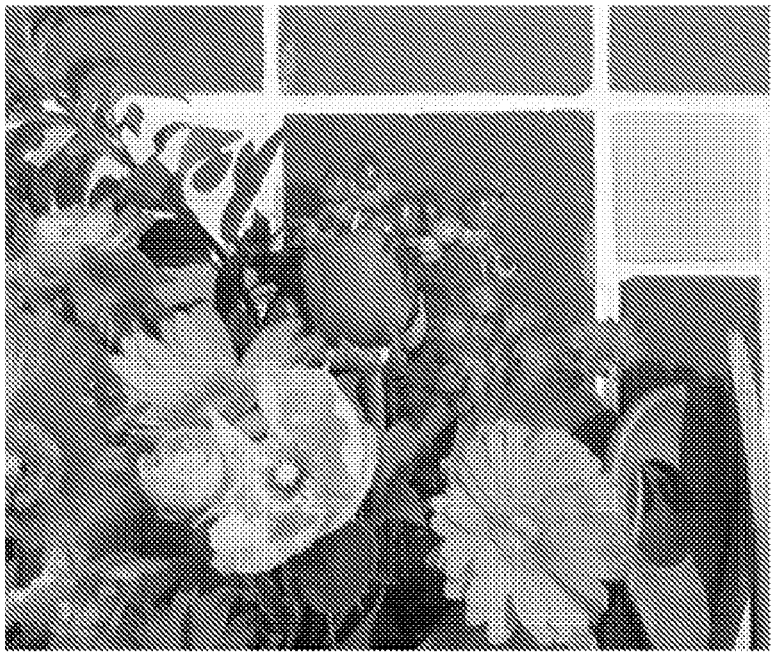
FIG. 13A is a view showing an image displayed on a liquid crystal display according to an exemplary embodiment of the present invention.
Figure 13B:
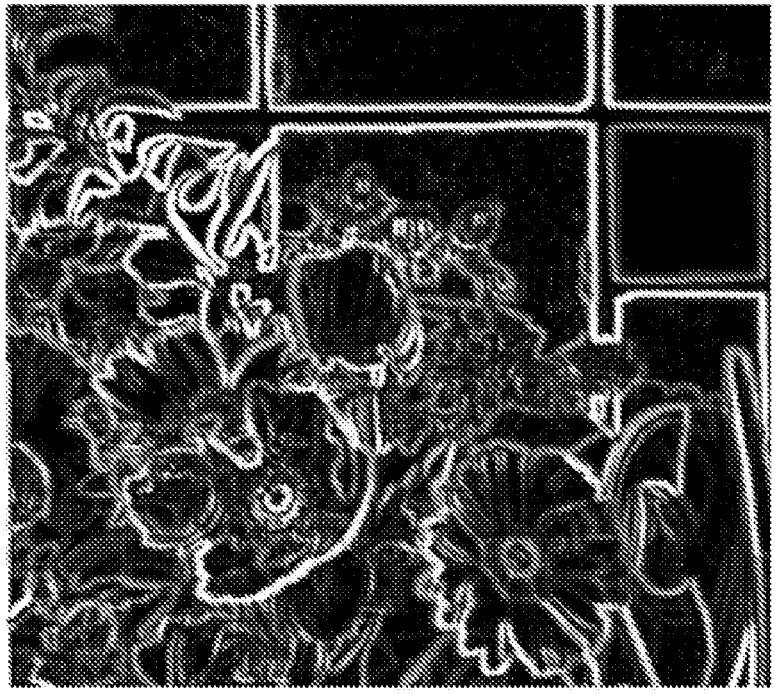
FIG. 13B is a view showing a result of detection of an edge of the image displayed on the liquid crystal display shown in FIG. 13A.

FIG. 10 is a block diagram showing an example of an edge detecting unit of the signal controller shown in FIG. 3. FIGS. 11A and 11B show operations of X-direction and Y-direction filters of the edge detecting unit shown in FIG. 10, respectively. FIGS. 12A to FIG. 12E are graphs showing responses of a scale adjusting unit in the edge detecting unit shown in FIG. 10. FIG. 13A is a view showing an image displayed on a liquid crystal display according to an exemplary embodiment of the present invention. FIG. 13B is a view showing a result of detection of an edge of the image displayed on the liquid crystal display shown in FIG. 13A.

Referring to FIG. 10, the edge detecting unit 650 of the signal controller 600 according to the exemplary embodiment includes a filter 651, a calculating unit 652, and a scale adjusting unit 653.

The filter 651 calculates a difference in gray values between an arbitrary pixel (hereinafter, referred to as a "central pixel") and peripheral pixels, FIGS. 11A and 11B represent functions of X-direction and Y-direction filters, respectively, as examples of the filter 651. The filter 651 represented in FIGS. 11A and 11B has the form of a 7×5 matrix and is less sensitive to noise that a small-sized filter. In order to detect the edge, the filter 651 may use a Roberts operator, a Rewitt operator, a Sobel operator, a Frei-Chen operator, or the like in a first order differential equation, or a Laplacian operator or the like in a second order differential equation.

The peripheral pixels denote pixels disposed at the left, right upper, and lower portions of the central, pixels with the same color. The number of peripheral pixels used for the calculation may be different according to the type of filter that is employed.

The calculating unit 652 receives the image signals $I_N$ for the central pixel and the peripheral pixels from the row memory 611, calculates a difference in gray values between the central pixel and the peripheral pixels, and outputs the difference in gray values to the scale adjusting unit 653. The calculation of the calculating unit 652 is based on Equation 3 as follows.

$$\mu(i, j) = K\left|\sum X(k, l)I_n(i+k, j+l)\right| + \lambda\left|\sum Y(k, l)I_n(i+k, j+l)\right| \quad \text{(Equation 3)}$$

Here, the μ(i, j) denotes a gray changing index of a (i, j) pixel, the $I_N$(I+K, j+1) denotes a gray value of a (i+k, j+1) pixel. The X(k, 1) and Y(k, 1) denote values of the k-th column and the 1-th low in FIGS. 11A and 11B, respectively, where $-3 \leqq k \leqq +3$ and $-2 \leqq 1 \leqq +2$ and the K and λ are proportional constants.

The scale adjusting unit 653 converts the gray changing index μ (i, j) to calculate the edge variable $\alpha_N$ (=f(μ)) for each pixel. The scale adjusting unit 653 may be constructed in a form of a lookup table. Various examples of the function f(x) are shown in FIGS. 12A to 12E.

FIG. 13A shows an example of an image displayed on a display device. When the above-described edge detection is performed on the original image shown in FIG. 13A, the edges are obtained as shown in FIG. 13B.

Returning to FIG. 3, the calculating unit 660 receives the first preliminarily-compensated signal $I_N'$, the second preliminarily-compensated signals $H_N$ and $L_N$, and the edge variable $\alpha_N$ from the first preliminary compensating unit 630, the second preliminary compensating unit 640, and the edge detecting unit 650, respectively, and calculates the first and second output image signals $A_N$ and $B_N$ based on the first preliminarily-compensated signal $I_N'$, the second preliminarily-compensated signals $H_N$ and $L_N$, and the edge variable $\alpha_N$. At this time, the first preliminary compensating unit 630 outputs the first preliminarily-compensated signal $I_N'$ twice. The calculation of the calculating unit 660 is performed based on Equation 4 as follows.

$$A_N=I_N'+\alpha_N(H_N-I_N'), \text{ and}$$

$$B_N=I_N'+\alpha_N(L_N-I_N') \quad \text{(Equation 4)}$$

In Equation 4, when the edge variable $\alpha_N$ is 0, both of the first and second output image signals $A_N$ and $B_N$ are equal to the first preliminarily-compensated signal $I_N'$. More specifically, when a pixel does not exist in an edge region of the image, the image signal is subjected to only the DCC. Therefore, the image signal that is subjected to the DCC during one frame is applied to the pixel twice.

If different voltages are applied to the pixel in the Image having an edge variable $\alpha_N$ of 0 in two fields divided from one frame, flicker may easily occur. According to an exemplary embodiment of the present invention, it is possible to prevent occurrence of flicker in the image having an edge variable $\alpha_N$ of 0, so that high, quality of image can be obtained.

On the other hand, when the edge variable $\alpha_N$ is greater than 0, the first and second output image signals $A_N$ and $B_N$ are different from each other.

The multiplexer 670 receives a field selection signal FS as an input and alternately selects the first and second output image signals $A_N$ and $B_N$ according to the field selection signal FS to output the selected output image signal as a final output image signal $I_N''$.

A method of applying a data voltage according to an exemplary embodiment of the present invention is described in detail with reference to FIGS. 14A and 14B.

Figure 14A:
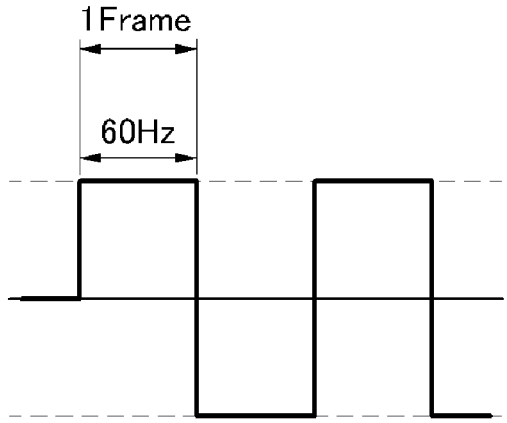
FIG. 14A is a waveform view showing a data voltage before an image signal is compensated in a liquid crystal display that employs the signal controller shown in FIG. 3.
Figure 14B:
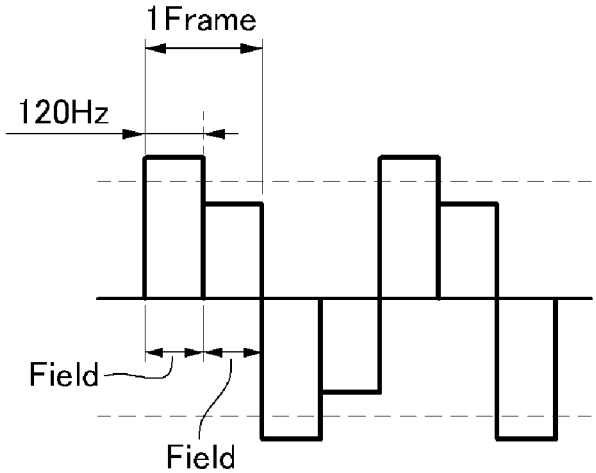
FIG. 14B is a waveform view showing a data voltage after the image signal is compensated in the liquid crystal display that employs the signal controller shown in FIG. 3.

FIG. 14A is a waveform view showing a data voltage before an image signal is compensated in a liquid crystal display that employs the signal controller shown in FIG. 3. FIG. 14B is a waveform view showing a data voltage after the image signal is compensated in the liquid crystal display that employs the signal controller shown in FIG. 3.

One of the first and second output image signals $A_N$ and $B_N$ is greater than or equal to the other. The greater one may be output prior to the smaller one, or vice versa. In a normally black mode liquid crystal display, as the image signal is greater, the corresponding data voltage Is also greater with reference to a common electrode. In an example shown in FIG. 14B, in such a normally black mode liquid crystal display, a data voltage corresponding to the greater one of the two output image signals $A_N$ and $B_N$ is output prior to that corresponding to the smaller one. More specifically, during each of the two fields divided from one frame, one of the first and second output image signals $A_N$ and $B_N$ is output. Accordingly, lateral visibility can be improved, and an impulsive driving effect can be selectively obtained.

FIG. 14A shows a data voltage when an uncompensated input image signal is directly output.

A signal controller according to an exemplary embodiment of the present invention is described in detail with reference to FIGS. 15 to 17B.

Figure 15:
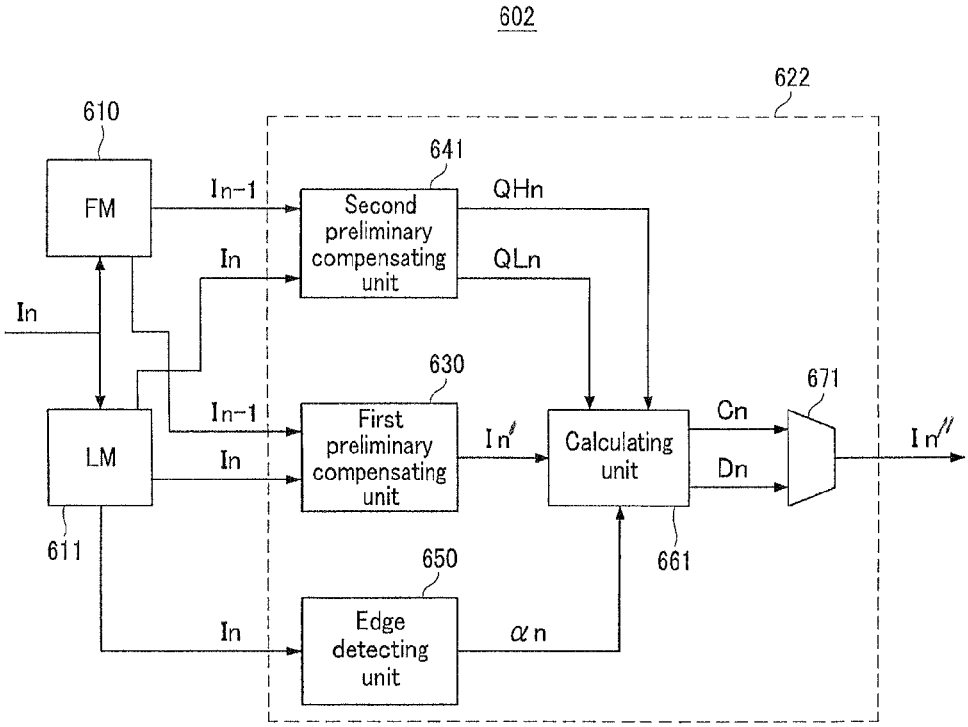
FIG. 15 is a block diagram showing a signal controller according to an exemplary embodiment of the present invention.
Figure 16:
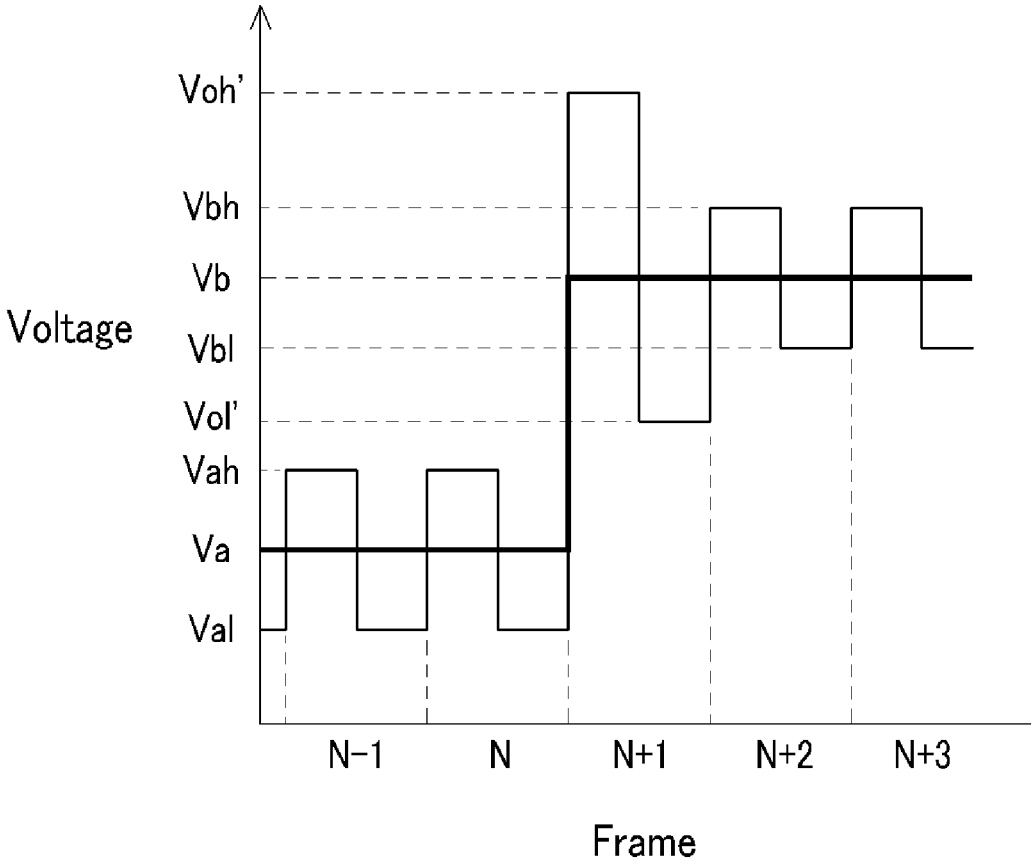
FIG. 16 is a graph showing a change in voltage with respect to time in a liquid crystal display that employs a third preliminary compensating unit of the signal controller shown in FIG. 15.

FIG. 15 is a block diagram showing a signal controller according to an exemplary embodiment of the present invention. FIG. 16 is a graph showing a change in voltage with respect to time in a liquid crystal display that employs a third preliminary compensating unit of the signal controller shown in FIG. 15. FIGS. 17A and 17B show lookup tables used in the third preliminary compensating unit of the signal controller shown in FIG. 15.

Referring to FIG. 15, the signal controller according to the exemplary embodiment includes a frame memory 610, a row or line memory 611, and an image signal compensating unit 622.

The frame and row memories 610 and 611 shown in FIG. 15 are substantially the same as those of the signal controller shown in FIG. 3 and, thus, a detailed description thereof is omitted.

The image signal compensating unit 622 includes a first preliminary compensating unit 630, a second preliminary compensating unit 641, an edge detecting unit 650, a calculating unit 661, and a multiplexer 671.

The first preliminary compensating unit 630 and the edge detecting unit 650 shown in FIG. 15 are substantially the same as those shown in FIG. 3. Namely, the first preliminary compensating unit 630 converts the current image signal $I_N$ received from the row or line memory 611 into the first preliminarily-compensated signal $I_N'$ based on the previous image signal $I_{N-1}$ received from the frame memory 610. The edge detecting unit 650 calculates the edge variable $\alpha_N$ based on the image signals $I_N$ for the pixel and the peripheral pixels received from the row or line memory 611.

The second preliminary compensating unit 641 converts the current image signal $I_N$ received from the row or line memory 611 into the second preliminarily-compensated signals including the upper and lower signal $QH_N$ and $QL_N$ based on the previous image signal $I_{N-1}$ received from the frame memory 610. The upper and lower signals $QH_N$ and $QL_N$ are determined according to a result of comparison of the previous image signal $I_{N-1}$ with the current image signal $I_N$. For example, the current image signal $I_N$ is initially converted into two upper and lower image signals according to the gamma curve shown in FIG. 7. Subsequently, the upper image signal is compared with the previous image signal $I_{N-1}$ and subjected to the DCC so as to generate the upper signal $QH_N$, and the lower image signal is compared with the upper image signal and subjected to the DCC to generate the lower signal $QL_N$. The result of calculations may be stored in a lookup table. Therefore, if only the previous and current image signals are inserted into the lookup table, the actual upper and lower signals $QH_N$ and $QL_N$ can be obtained. In this case, the upper signal $QH_N$ is output prior to the lower signal $QL_N$. As a result, the upper signal $QH_N$ becomes higher than the upper image signal, and the lower signal $QL_N$ becomes lower than the lower image signal. Alternatively, only the upper signal $QH_N$ may be subjected to the DCC. In another approach, both the upper and lower signals $QH_N$ and $QL_N$ may be obtained through experiments.

The second preliminary compensating unit 641 is described in more detail with reference to FIGS. 16 to 17B.

FIG. 16 is a graph showing data voltages corresponding to the first and second preliminarily-compensated signals in a liquid crystal display according to an exemplary embodiment of the present invention.

Similar to FIG. 9, in FIG. 16, the horizontal axis denotes time in units of a frame, and the vertical axis denotes a data voltage in absolute value.

The graph of FIG. 16 is obtained from the same input image signals as those of FIG. 9, and the graph of FIG. 16 is similar to that of FIG. 9 in terms of shape.

In the (N+1)-th frame of which the current image signal is different from the input image signal of the previous frame, however, the upper data voltage Voh' is higher than the target data voltage Vb, and the lower data voltage Vol' is lower than the target data voltage Vb. In addition, the lower data voltage Vol' may change.

An example of the second compensated signal is shown in FIGS. 17A and 17B. FIGS. 17A and 17B show the upper and lower signals $QH_N$ and $QL_N$ of the second preliminarily-compensated signal that is obtained in units of 16 gray values in the case of 256-gray values.

The first and second output image signals and $C_N$ and $D_N$ can be determined by Equation 5 as follows.

$$C_N=I_N'+\alpha_N(QH_N-I_N'), \text{ and}$$

$$D_N=I_N'+\alpha_N(QL_h-I_N') \quad \text{(Equation 5)}$$

Equation 5 is substantially equal to Equation 4 in terms of form.

According to exemplary embodiments of the present invention, in a case where no edge exists in an image, it is possible to prevent occurrence of flicker and to increase a response speed of the liquid crystal molecules. In addition, in a case where an edge exists in the image, it is possible to prevent occurrence of blurring and to increase the response speed of liquid crystal molecules. In addition, it is possible to reduce a difference between front and lateral visibilities, so that image quality of a liquid crystal display can be improved.

While this invention has been described in connection with what is presently considered to be exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A driving device for a display device, comprising:

a signal controller that converts an input image signal input at a first frequency and corresponding to each pixel into first and second output image signals and alternately outputs the first and second output image signals at a second frequency higher than the first frequency; and a data driver that alternately applies the first and second output image signals to the pixels in respective fields of each frame, wherein the signal controller compares the input image signal of a present frame with the input image signal of a previous frame to convert the input image signal of the present frame into a first preliminarily-compensated signal, converts the input image signal of the present frame into a second preliminarily-compensated signal comprising upper and lower signals or converts the first preliminarily-compensated signal into a third preliminarily-compensated signal including the upper and lower signals, and generates the first and second output signals based on the first and second preliminarily-compensated signals or the first and the third preliminarily-compensated signals and an edge detection value for an image calculated based on a difference between the input image signals for the pixels, wherein, when the pixel exists in an edge region of the image, the first and second output image signals are different from each other, and when the pixel does not exist in the edge region of the image, the first and second output image signals are equal to each other, wherein the first and second output image signals $A_N$ and $B_N$ converted from the input image signal $I_N$ of the present frame satisfy $A_N=I_N+\alpha_N(H_N-I_N)$ and $B_N=I_N+\alpha_N(L_N-I_{N'})$, wherein $I_{N'}$ denotes the first preliminarily-compensated signal, $\alpha_N$ denotes an edge variable, and $H_N$ and $L_N$ denote the upper and lower signals of the second or third preliminarily-compensated signal, respectively, and an average of a gamma curve of the upper signal and a gamma curve of the lower signal is equal to a gamma curve of the first preliminarily-compensated signal.

2. The driving device of claim 1, wherein the second frequency is twice the first frequency.

3. The driving device of claim 1, wherein a gray value of the lower signal is 0.

4. The driving device of claim 1, wherein, when the input image signal of the present frame is greater by a predetermined value than the input image signal in the previous frame, the first preliminarily-compensated signal is greater than the input image signal of the present frame.

5. The driving device of claim 1, wherein the lower signal of the second preliminarily-compensated signal is lower than the lower signal of the third preliminarily-compensated signal.

6. The driving device of claim 1, wherein a sum of light intensities of the pixel due to the upper and lower signals of the third preliminarily-compensated signal is equal to a light intensity of the pixel due to the first preliminarily-compensated signal.

7. The driving device of claim 1, wherein the signal controller comprises;

a frame memory that stores the input image signal of the present frame in units of a frame;

a row memory that stores the input image signal of the present frame in units of a row; and an image signal compensating unit that receives the input image signal of the present frame from the frame and row memories and generates the first and second output image signals.

8. The driving device of claim 7, wherein the image signal compensating unit comprises:

a first preliminary compensating unit that converts the input image signal of the present frame into the first preliminarily-compensated signal based on the input image signal in the previous frame;

a second preliminary compensating unit that converts the input image signal of the present frame or the first preliminarily-compensated signal into the second preliminarily-compensated signal;

an edge detecting unit that detects the edge variable based on the input image signal of the present frame;

a calculating unit that calculates the first and second output image signals based on the first preliminarily-compensated signal, the upper signal of the second preliminarily-compensated signal, the lower signal of the second preliminarily-compensated signal, and the edge variable; and a multiplexer that alternately selects and outputs the first and second output image signals from the first calculating unit.

9. The driving device of claim 8, wherein, the edge detecting unit comprises:

a second calculating unit that calculates a difference in gray values between the pixels; and a scale adjusting unit that calculates the edge variable based on information on the difference in gray values received from the second calculating unit.

10. A method of compensating an image signal of a display device, comprising steps of:

reading previous and current image signals of each pixel;

compensating the current image signal based on the previous image signal to calculate a first preliminarily-compensated signal;

determining an upper signal and a lower signal of a second preliminarily-compensated signal based on the current input image signal or the first preliminarily-compensated signal, an average of a gamma curve of the upper signal and a gamma curve of the lower signal being equal to a gamma curve of the first preliminarily-compensated signal;

determining whether the pixel exists in an edge region of the image based on the current image signal;

for the pixel that does not exist in the edge region of the image, outputting the first preliminarily-compensated signal in respective fields of each frame; and for the pixel that exists in the edge region of the image, alternately outputting in the respective fields of each frame first and second output signals based on the first preliminarily-compensated signal, the upper signal and the lower signal of the second preliminarily-compensated signal, and an edge variable generated from determining existence of an edge in an image, wherein a frame frequency of the output image signal is higher than a frame frequency of the current image signal, wherein the first and second output image signals $A_N$ and $B_N$ converted from the current input image signal $I_N$ satisfy $A_N=I_{N'}+\alpha_N(H_N-I_{N'})$ and $B_N=I_{N'}+\alpha_N(L_N-I_{N'})$, wherein $I_{N'}$ denotes the first preliminarily-compensated signal, $\alpha_N$ denotes the edge variable, and $H_N$ and $L_N$ denote the upper and lower signals of the second preliminarily-compensated signal, respectively, and an average of a gamma curve of the upper signal and a gamma curve of the lower signal is equal to a gamma curve of the first preliminarily-compensated signal.

11. The method of claim 10, wherein the frame frequency of the output image signal is twice the frame frequency of the current image signal.

12. The method of claim 10, wherein the upper signal of the second preliminarily-compensated signal is greater than the first preliminarily-compensated signal, and the lower signal of the second preliminarily-compensated signal is smaller than the first preliminarily-compensated signal, and wherein a sum of light intensities of the pixel due to the upper and lower signals of the second preliminarily-compensated signal is substantially equal to a light intensity of the pixel due to the first preliminarily-compensated signal.

13. The method of claim 10, wherein a gray value of the lower signal is 0.

14. The method of claim 10, wherein, when the current input image signal is greater by a predetermined value than the previous input image signal, the first preliminarily-compensated signal is greater than the input image signal.

15. The method of claim 10, wherein the first output image signal is greater than the second output image signal.

* * * * *